United States Patent [19]

Czajkowski

[11] 3,981,740

[45] Sept. 21, 1976

[54] METHOD FOR THE REMOVAL AND INHIBITION OF METAL SCALE FORMATION IN A HYDROCARBON PROCESSING UNIT

[75] Inventor: George J. Czajkowski, Chicago, Ill.

[73] Assignee: Universal Oil Products Company, Des Plaines, Ill.

[22] Filed: Apr. 19, 1974

[21] Appl. No.: 462,479

[52] U.S. Cl. ..... 134/2; 21/2.5 R; 21/2.5 B; 134/31; 148/16; 148/20.6; 208/47; 252/87

[51] Int. Cl.[2] ..... C23F 9/02; C23F 11/16; C23F 14/02

[58] Field of Search ..... 134/2, 3, 42, 31, 22 R; 148/16, 20.3, 20.6, 6.35; 252/87; 208/47; 29/81 C; 21/2.5 R, 2.5 B

[56] References Cited

UNITED STATES PATENTS

| | | | |
|---|---|---|---|
| 312,142 | 2/1885 | McCandless | 134/2 X |
| 701,508 | 6/1902 | Robinson | 252/87 |
| 1,139,873 | 5/1915 | Jayme | 134/22 R |
| 1,293,585 | 2/1919 | Wakefield | 252/87 |
| 1,321,182 | 11/1919 | Allen | 134/3 |
| 1,629,486 | 5/1927 | Dougherty | 134/22 R X |
| 1,795,785 | 3/1931 | Lockwood | 134/2 UX |
| 2,261,700 | 11/1941 | Ryznar | 252/87 |
| 2,385,175 | 9/1945 | Wachter et al. | 134/2 X |
| 2,464,730 | 3/1949 | Sutherland | 134/31 X |
| 2,637,667 | 5/1953 | Binder | 134/2 UX |
| 2,662,042 | 12/1953 | Dougherty et al. | 134/22 R |
| 3,172,832 | 3/1965 | Dreyer et al. | 208/47 |
| 3,181,541 | 5/1965 | Brooking | 134/22 R |
| 3,259,521 | 7/1966 | Crall | 134/22 R |
| 3,514,410 | 5/1970 | Engle et al. | 252/87 |
| 3,547,806 | 12/1970 | Matyear | 208/47 X |
| 3,732,123 | 5/1973 | Stolfa et al. | 134/42 X |

*Primary Examiner*—Morris O. Wolk
*Assistant Examiner*—Bradley R. Garris
*Attorney, Agent, or Firm*—James R. Hoatson, Jr.; Thomas K. McBride; William H. Page II

[57] ABSTRACT

A method for the inhibition of metal scale formation in a hydrocarbon processing unit prior to catalyst loading and start-up comprising the steps: circulating a gas comprising a sulfiding component; heating the hydrocarbon conversion zone to at least hydrocarbon conversion temperature; and, collecting loosely bound metal scale until scale production abates. The recurring problem of catalyst bed inlet plugging is solved by removing indigenous metal scale, dust and debris and by passivating the virgin metallic surfaces before the initial start-up of a hydrocarbon processing unit.

2 Claims, No Drawings

METHOD FOR THE REMOVAL AND INHIBITION OF METAL SCALE FORMATION IN A HYDROCARBON PROCESSING UNIT

This invention relates to a procedure to increase the first cycle run length of a hydrocarbon processing unit. More specifically, my invention relates to a method for the removal of indigenous metal scale, dust and debris, and for passivating the virgin metallic surfaces in order to inhibit the formation of a metallic scale which is prone to separate from the internal metallic surfaces of the hydrocarbon processing unit during normal operation thereof.

Hydrocarbon processing units of the commercial variety are usually located outdoors in a petroleum or petrochemical refinery complex. The initial construction of a typical hydrocarbon processing unit beings in a muddy field with complete exposure to the elements such as the sun, rain, snow, wind, etc. The hydrocarbon processing unit is constructed upon footings and foundations and is fashioned from a myriad of various sized pipes, heat exchangers, pumps, direct fired heaters, reactors, feed surge tanks, and high pressure separator vessels. The materials of construction of the internal surface of the processing unit are usually carbon steel or low alloy steel and the internal surface area in a modestly sized unit is usually thousands of square feet. Since the component parts may have been manufactured up to two years or more prior to actual construction of the unit and since the larger components are never stored in warehouses and are exposed to the weather, there is ample opportunity for the metal surfaces to oxidize or rust and in general to form metallic scale thereon. Much of the carbon steel piping will also be encrusted with mill scale which is formed during the initial production of the pipe.

The hereinabove described indigenous metal scale which is present in newly constructed hydrocarbon processing units has deleterious delerious effect upon the smooth and efficient start-up and operation of a processing unit. For example, in processing units for the hydrogenation, hydrocracking, denitrification or desulfurization of hydrocarbons, a fixed bed catalytic reaction zone is utilized which is loaded with finely divided catalytic particles in the form of spheres, pills, extrudates or any other convenient particulate matter ranging in nominal diameter from about 1/32 inch to about 2 inches. The bed of catalyst may range in depth from a few inches up to 80 feet or more. Such a catalyst bed configuration is an efficient collector of any metal scale and debris which is present in the flow through the bed. And if during start-up or shortly thereafter the scale and debris are sufficient to effectively inhibit the free flow through the catalyst bed or produces undesirable channeling, the unit must be shut down to remove any such debris and scale. An interruption in processing is costly and time consuming which often seriously impairs production scheduling and may often cause other dependent units to shut down or to delay any dependent units start-up. Since many processing units are integrated systems, the failure of one unit greatly magnifies the seriousness of a problem area in one particular unit.

The problem of catalyst bed plugging is even more serious when the unit is designed to process the heavier oils extracted from tar sands, shale oil, topped or reduced crudes and vacuum residuum which contain high molecular weight sulfurous compounds in exceedingly large quantities, nitrogenous compounds, high molecular weight organometallic complexes (principally containing nickel and vanadium) and light hydrocarbon-insoluble material. The above-mentioned heavier oils ar commonly known in the petroleum refining art as "black oils" and are generally characterized as a heavy hydrocarbonaceous material of which more than about 10 percent by volume boils above a temperature of 1050°F. and which have a gravity less than about 20° API. Sulfur concentrations are exceedingly high, being more than 1 percent by weight and often in excess of 3 percent. There currently exists an abundant supply of such hydrocarbonaceous material; however, the utilization thereof, as a source of more valuable distillable liquid hydrocarbon products is precluded unless a successful technique can be used to further process them. An essential step to having a successful technique for the processing of these black oils is the ability to eliminate interruptions caused by accumulation of metal scale and debris on the top of a catalyst bed.

I have found a method which eliminates premature shut-down of a hydrocarbon processing unit caused by accumulation of metal scale and debris on the top of a catalyst bed comprising the following steps: (a) circulating a normally liquid hydrocarbon and a hydrogen-containing gas comprising a sulfiding component; (b) heating the hydrocarbon conversion zone to at least hydrocarbon conversion temperature; and, (c) collecting loosely bound metal scale until scale production abates.

The method of the present invention is further described and exemplified by the examples presented hereinbelow.

The principal object of the present invention is a method for the inhibition of metal scale formation in a hydrocarbon processing unit prior to catalyst loading and start-up comprising the steps: (a) circulating a normally liquid hydrocarbon and a gas comprising a sulfiding component; (b) heating the hydrocarbon conversion zone to at least hydrocarbon conversion temperature; and, (c) collecting loosely bound metal scale until scale production abates.

Another object of my invention is to prevent the recurring problem of catalyst bed inlet plugging by removing indigenous metal scale, dust and debris and by passivating the virgin metallic surfaces before the initial start-up of a hydrocarbon processing unit.

Yet another object of my invention is to minimize the interruptions of hydrocarbon processing caused by the premature collection of metal scale on the top of the catalyst bed.

As hereinbefore set forth, my invention relates to a method for the inhibition of metal scale formation in a hydrocarbon processing unit prior to catalyst loading and start-up comprising the steps: (a) circulating a normally liquid hydrocarbon and a hydrogen-containing gas comprising a sulfiding component; (b) heating the hydrocarbon conversion zone to at least hydrocarbon conversion temperature; and, (c) collecting loosely bound metal scale until scale production abates.

Hydrocarbon processing units which may benefit from the method of my invention are, for example, hydrogenation, denitrification, desulfurization, isomerization, dehydrogenation, hydrocracking, reforming, and hydrodealkylation units. However, the method is most advantageously utilized in a processing unit which has a feedstock containing a significant quantity of sulfur. Therefore, the method of the present invention is preferably used in hydrogenation, denitrification and desulfurization units.

Although the catalysts used in the hereinabove described units usually comprise inorganic oxide carrier material, such as silica and alumina and a catalytically active metal component such as one or more of the metals of Group VI-B and VIII of the Periodic Table of the Elements, such selection of a particularly suitable catalyst is not an essential feature of my invention. The actual configuration of the individual catalyst particles, e.g., spheres, pills, extrudates, cylinders, etc., is also not an essential feature of my invention.

The circulating gas of the present invention is hydrogen or a hydrogen-containing gas. Such a hydrogen-containing gas could have small quantities of other gases, such as, nitrogen and normally gaseous hydrocarbons but any non-hydrogen components should preferably comprise less than 25 percent and more preferably less than 10 percent of the circulating gas.

The normally liquid hydrocarbon of the present invention may be the design feedstock or any suitable distillate hydrocarbon, such as, straight-run naphtha, kerosene, gas oil, etc.

The hereinabove-mentioned sulfiding component is preferably a sulfur compound selected from the sulfur compounds consisting of hydrogen sulfide, alkyl mercaptans and alkyl sulfides. The sulfiding component is generally present as hydrogen sulfide and this material is generally gaseous in form and easily maintained in admixture with the circulating gas stream. The sulfur compound is not necessarily limited to the single use of hydrogen sulfide or alkyl sulfides or alkyl mercaptans but may include various combinations thereof introduced into the circulating gas. The concentration of the sulfiding component in the circulating gas must be sufficient to effectively passivate the metal surfaces in a reasonable amount of time. An alternate method of maintaining a given concentration of $H_2S$ in the circulating gas would be to load a small quantity of a desulfurization catalyst in the bottom of the reactor (this would substitute for the filter also). During the hot oil circulation enough desulfurization would occur to replace $H_2S$ consumed in the passivating reactions. The time required for circulation of the sulfiding component will preferably be from about one day to about ten days. Effective concentrations of the sulfiding component range from about 0.01 volume percent to about 10 volume percent based on the total circulation gas.

The method of this invention is applicable to all hydrocarbon processing units and, in particular, hydrogenation, denitrification, and desulfurization units. Hydrocarbon conversion temperatures are usually in the range of from about 400° to about 1200°F. and preferably from about 500° to about 900°F.

Collection of loosely bound metal scale which separates from the internal surfaces of the hydrocarbon processing unit during the application of the method of the invention may be accomplished in the bottom of each reactor or vessel which may be present, or in any other low spot such as pipe elbows or in temporary screens which may be inserted at convenient locations such as flanged pipe joints. In the case of a particularly "dirty" unit which has a large quantity of scale, it may be advantageous to start with a screen or screens which collect only a portion of the scale and then to install progressively finer screens to collect any remaining metal scale.

The following examples are given to further illustrate the method of the present invention and to indicate the benefits to be afforded through the utilization thereof. It is understood that the examples are given for the sole purpose of illustration and that they are not intended to limit the generally broad scope and spirit of the appended claims.

EXAMPLE I

A newly constructed hydrocarbon processing unit designed for the hydrodesulfurization of 15,000 barrels per day of atmospheric gas oil is directly loaded with a commercial cobaltmolybdenum hydrotreating catalyst. The unit is then started up and operated at design operating conditions including a pressure of 1500 psig., a liquid hourly space velocity of 2 and a catalyst peak temperature of 720°F. Immediately after start-up, the pressure drop across the reaction zone catalyst is about 15 psig. After about 35 days of continuous operation, the reactor zone pressure drop has increased to about 60 psig. This increased pressure drop has prevented the required hydrogen flow over the catalyst which if allowed to continue will cause premature carbon deactivation of the catalyst. Because of this high pressure drop across the catalyst, the entire unit is shut down to remove the obstruction at the inlet to the catalyst bed. After opening the reaction zone, inspection shows that the top six inches of catalyst is plugged with finely divided metal scale and that a 2 inch thick deposit of metal scale rests on the top of the catalyst bed. Operation of the unit is resumed after the metal scale is removed from the catalytic reaction zone.

EXAMPLE II

A second newly constructed hydrocarbon processing unit designed for the hydrodesulfurization of 15,000 barrels per day of atmospheric gas oil is pressurized with hydrogen to 1000 psig. before the catalyst is loaded into the reactor. Then enough hydrogen sulfide is added to the unit so that the hydrogen-hydrogen sulfide mixture contains about 1 percent hydrogen sulfide. After the gas circulation has begun and design quantities of atmospheric gas oil are being charged to the unit, the conversion zone is then slowly heated to 750°F. at a rate of about 100°F. per hour. $H_2S$ content of the circulating gas is monitored by continuous or periodic sampling. Concentration of $H_2S$ is maintained by addition of $H_2S$ as necessary. The conversion zone is maintained at 750°F. for about 24 hours and then the unit is cooled and depressured. After following normal procedures to free the unit of combustible material, the metal scale accumulation in the bottom of the reaction zone is removed and the conversion zone is charged with a commercial hydrotreating catalyst identical to that used in Example I. The unit is then started and lined-out to the same operating conditions as in Example I. After the unit has been in continuous operation for eight months, the reaction zone pressure drop has increased from 15 psig. to 24 psig. which is primarily attributed to expected homogeneous carbon laydown through the catalyst bed and not to metal scale plugging.

The foregoing demonstrates the method by which the present invention is effected and the benefits afforded through the utilization thereof.

I claim as my invention:

1. A method of removing metal oxide and mill scale and inhibiting further metal scale formation in a catalytic hydrocarbon conversion processing unit having internal steel surfaces, which comprises simultaneously circulating through said unit, prior to the first cycle catalytic conversion therein, a normally liquid hydrocarbon selected from the group consisting of gas oil, kerosene, straight-run naphtha, and black oils, a gas containing primarily hydrogen, and a sulphur compound selected from the group consisting of hydrogen sulfide, alkyl mercaptans and alkyl sulfides while heating said unit to a temperature of from about 400°F. to about 1200°F., thereby separating loosely bound metal scale from the internal surfaces of the processing unit, and removing thus separated metal scale from the processing unit prior to the catalytic conversion therein.

2. The method of claim 1 further characterized in that said sulfur compound is hydrogen sulfide.

* * * * *